US005253616A

United States Patent [19]

Voss

[11] Patent Number: 5,253,616

[45] Date of Patent: Oct. 19, 1993

[54] TUBULAR INTAKE MANIFOLD AND METHOD FOR MAKING SAME

[75] Inventor: Karl D. Voss, Farmington Hills, Mich.

[73] Assignee: CMI International, Inc., Southfield, Mich.

[21] Appl. No.: 821,636

[22] Filed: Jan. 15, 1992

[51] Int. Cl.[5] ..... F02M 35/10

[52] U.S. Cl. ..... 123/52 MC; 29/458

[58] Field of Search ..... 123/52 M, 52 MC, 52 MV, 123/52 MB; 29/890.08, 428, 458, 527.2; 228/183, 263.17

[56] References Cited

U.S. PATENT DOCUMENTS

| | | | |
|---|---|---|---|
| 3,165,983 | 1/1965 | Thomas | 92/169 |
| 3,276,082 | 10/1966 | Thomas | 22/204 |
| 3,440,712 | 4/1969 | Stroup et al. | 228/263.17 |
| 3,633,266 | 1/1972 | Taylor | 228/183 |
| 3,750,248 | 8/1973 | Morris | 228/183 |
| 4,194,043 | 3/1980 | Lee et al. | 123/52 M |
| 4,613,069 | 9/1986 | Falke et al. | 228/263.17 |
| 4,645,119 | 2/1987 | Haramaki et al. | 228/183 |
| 4,727,001 | 2/1988 | Takemoto et al. | 228/263.17 |
| 4,829,944 | 5/1989 | Sukimoto et al. | 123/52 M |
| 4,887,557 | 12/1989 | Sukimoto et al. | 123/52 MC |
| 4,908,923 | 3/1990 | Anderson et al. | 29/888.01 |
| 4,955,525 | 9/1990 | Kudo et al. | 228/183 |
| 5,016,578 | 5/1991 | Ogawa et al. | 123/52 MC |
| 5,072,789 | 12/1991 | Usui et al. | 228/183 |

*Primary Examiner*—David A. Okonsky

*Attorney, Agent, or Firm*—Reising, Ethington, Barnard, Perry & Milton

[57] ABSTRACT

An intake manifold (10) includes cast plenum (12) and flange (14) members defining a plurality of outlet (22) and inlet (24) holes therein. Tubes (16) have opposite first (44) and second (46) ends which are received into the outlet (22) and inlet (24) holes with an interference fit and joined thereto with metallurgical bonds (48,50) comprising a low melting point metal coating material (52), such as zinc, alloyed with the tube metal and each of the plenum and flange metals. The method includes coating the ends (44,46) of the tubes (16) and the walls of the holes (22,24) with the molten coating material (52), heating the plenum (12) and flange (14) to an elevated temperature and then forcing the tubes (16) into the holes (22) to form the metallurgical bonds (48,50).

24 Claims, 3 Drawing Sheets

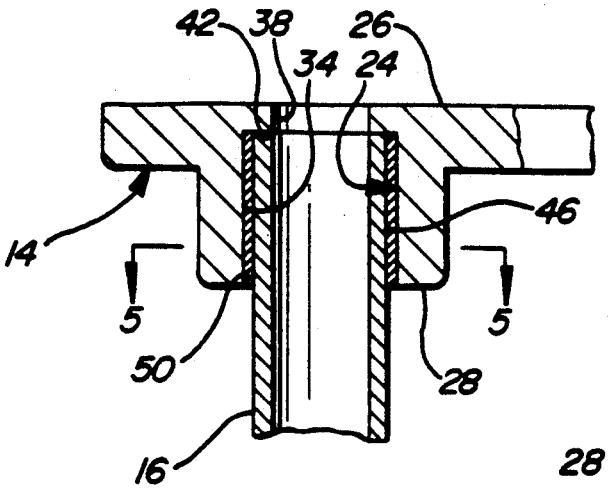
FIG-4
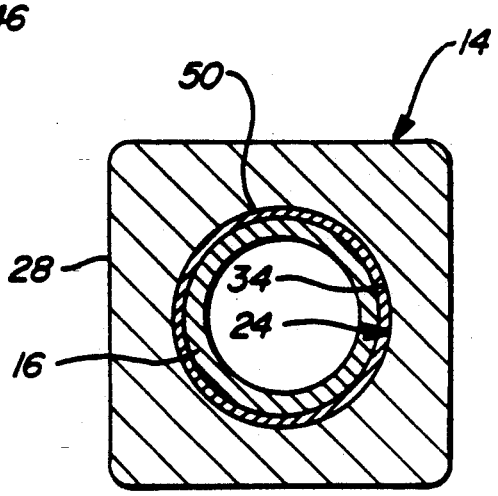
FIG-5
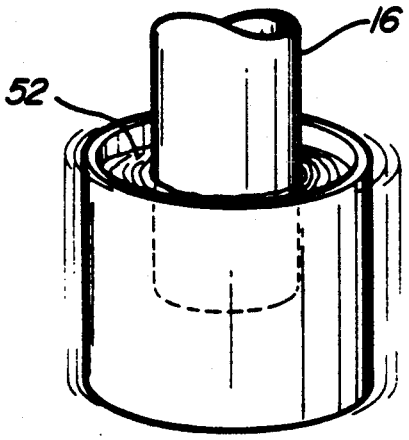
FIG-6
FIG-7
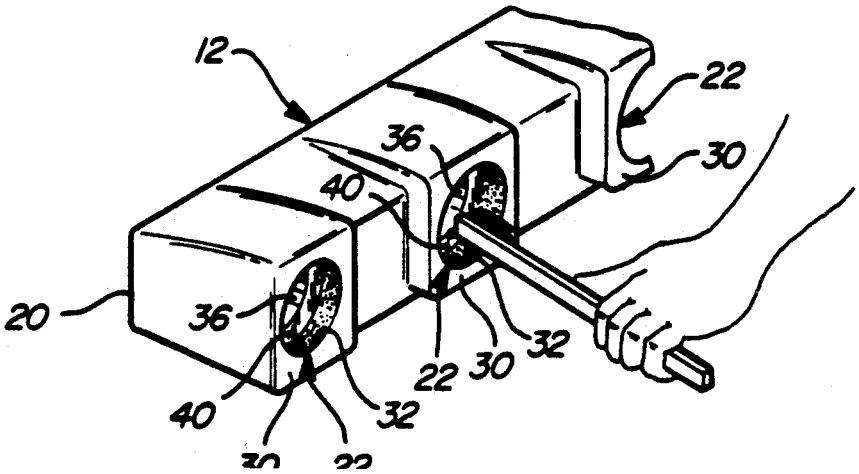

FIG-8
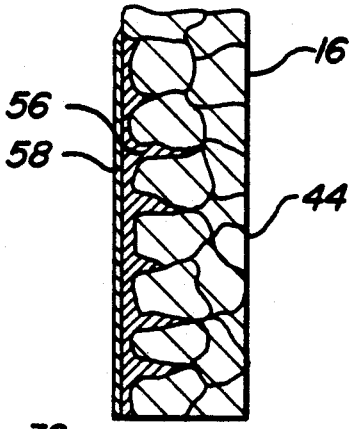
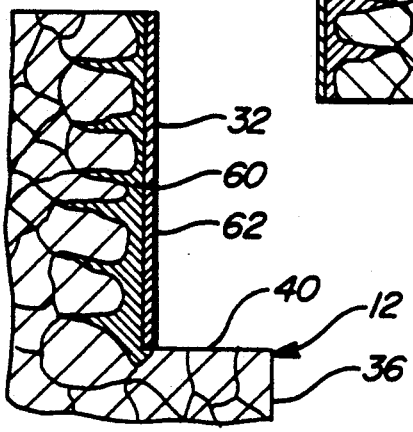
FIG-9
FIG-10
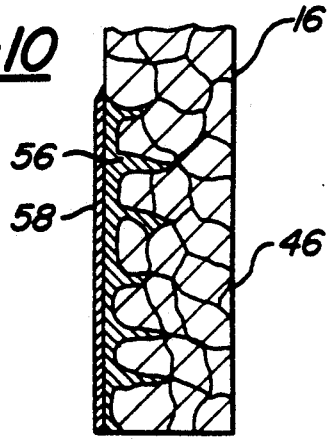
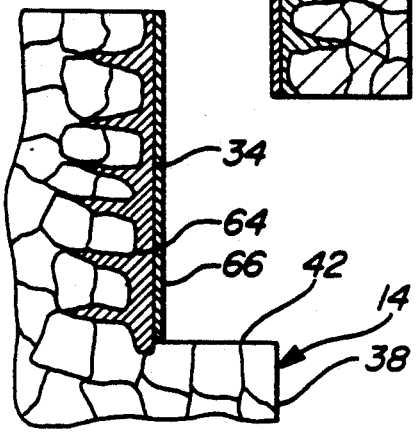
FIG-11
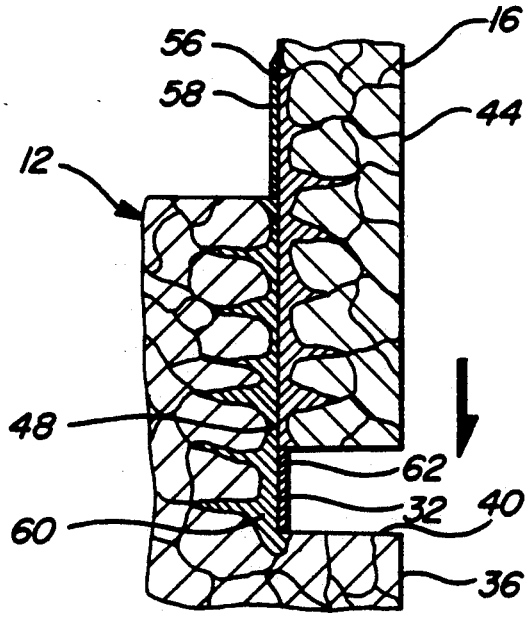
FIG-12
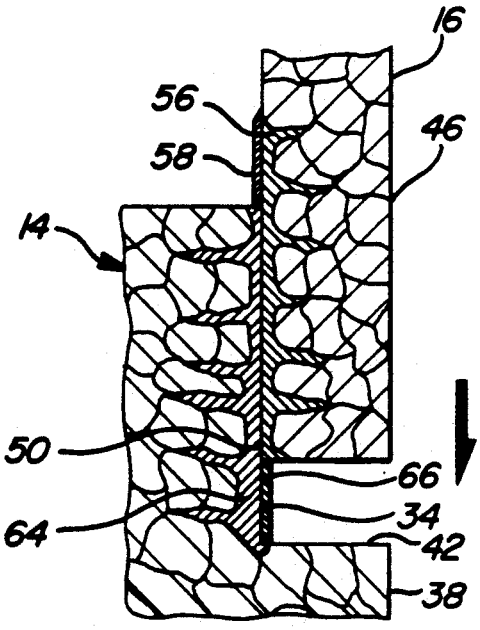
FIG-13

TUBULAR INTAKE MANIFOLD AND METHOD FOR MAKING SAME

TECHNICAL FIELD

The present invention relates to intake manifolds for use in internal combustion engines and to methods for producing such manifolds.

BACKGROUND OF THE INVENTION

Intake manifolds for automotive engines typically are comprised of a plenum or chamber having an open end and an opposite closed end and defining a plurality of outlet holes therebetween. The intake manifold also includes a plurality of tubes having first ends joined with the outlet holes of the plenum and opposite second ends connected with associated holes of a flange member which is adapted for mounting to a cylinder head of an engine.

Intake manifolds are traditionally produced entirely by casting These castings are fairly heavy and add undesirable weight to a vehicle Furthermore, since the tubes are usually U-shaped, the manifold cannot be cast in one piece but rather must be cast in two sections, with one section comprising a length of the tubing cast integrally with the plenum and the other section comprising the remaining length of the tubing cast integrally with the flange member. The halves must then be joined together with bolts and a gasket or other suitable hardware to complete the manifold, further adding to the cost, weight and complexity of the manifold.

The U.S. Pat. Nos. 4,829,944, granted May 16, 1989 and 4,887,557, granted Dec. 19, 1989, both in the name of Sukimoto et al., disclose an intake manifold in which the tubes are formed separately from the plenum and flange members out of wrought aluminum The tubes then are joined to the plenum and flange members by a furnace brazing process. Although this type of intake manifold is lighter weight and more aesthetically pleasing than the traditional all-cast type manifolds, it is deficient in that brazed joints are employed.

Brazing employs a brass filler material (i.e., a copper based alloy having zinc or zinc and silver as the alloyant) and is performed at temperatures exceeding 1100° F. Such high temperature brazing processes are costly and present problems of dimension control of the tubes, plenum and flange as these pieces are being joined Furthermore, brazed joints have a tendency to crack over an extended period of time as they are subjected to thermal cycling during normal use.

SUMMARY OF THE INVENTION AND ADVANTAGES

The present invention provides an intake manifold assembly comprising a metal tubular plenum member having an open end and an opposite closed end and defining a plurality of outlet holes formed in its peripheral wall. A metal flange member is spaced from the plenum and defines a plurality of inlet holes extending through the flange. A plurality of tubes extend between the plenum and flange and are formed with opposite ends inserted into each of the respective outlet and inlet holes. The manifold assembly is characterized by metallurgical bond comprising a zinc-based metal material alloyed with the tube metal and the plenum metal for joining one end of the plurality of tubes to the plenum and further comprising the zinc-based metal material alloyed with the tube metal and the flange metal for metallurgically joining the other end of the tubes to the flange.

The method of producing the tubular intake manifold of the subject invention comprises forming the metal tubular plenum with the open and opposite closed ends and formed with annular wall portions defining a plurality of outlet holes in its peripheral wall. A complimentary flange member is also formed with annular wall portions which define a plurality of inlet holes extending through the flange. The walls of the outlet and inlet holes present a set of joining surfaces. A plurality of the metal tubes are also formed with opposite ends for press-fit engagement into the associated holes of the plenum and flange members. The ends of the tubes also present a complimentary set of joining surfaces. One or more sets of the joining surfaces are coated with a low melting point molten metal coating material and allowed to solidify. The tubes, plenum and flange members are then heated to an elevated temperature and the ends of the tubes thereafter forced into the associated holes of the plenum and flange members so that the coated joining surfaces are in interference engagement with one another. This causes the coating material to alloy with the tube metal and further with each of the plenum and flange metals and form a metallurgical bond joining the ends of the tubes to each of the plenum and flange members.

The metallurgical bond produced by the present invention is more durable than a brazed joint and is not prone to cracking when the manifold under goes thermal cycle during normal use.

Another advantage of the present invention is that the joining process is carried out at a much lower temperature than brazing processes and thus the manifold is less prone to distortion.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is a fragmentary cross-sectional view showing the metallurgically bonded joint between the tube and flange;

FIG. 5 is a cross-sectional view taken along lines 5—5 of FIG. 4;

FIG. 6 shows an end of one of the tubes being coated in an ultrasonic molten bath of zinc;

FIG. 7 is a perspective view showing molten zinc coating material being wire brushed into the outlet hole of the plenum;

FIG. 8 is an enlarged fragmentary cross-sectional view of a coated first end of a tube;

FIG. 9 is an enlarged fragmentary cross-sectional view of a coated hole of the plenum;

FIG. 10 is a view like FIG. 8 but showing a coated second end of a tube;

FIG. 11 is a view like FIG. 9 but of a coated hole of the flange;

FIG. 12 is an enlarged fragmentary cross-sectional view showing the first tube end of FIG. 8 being pressed into the hole of the plenum of FIG. 9; and FIG. 13 is a view like FIG. 12 but showing the second end of the tube of FIG. 10 being pressed into the hole of the flange of FIG. 11.

DETAILED DESCRIPTION OF THE DRAWINGS

Figure 1:
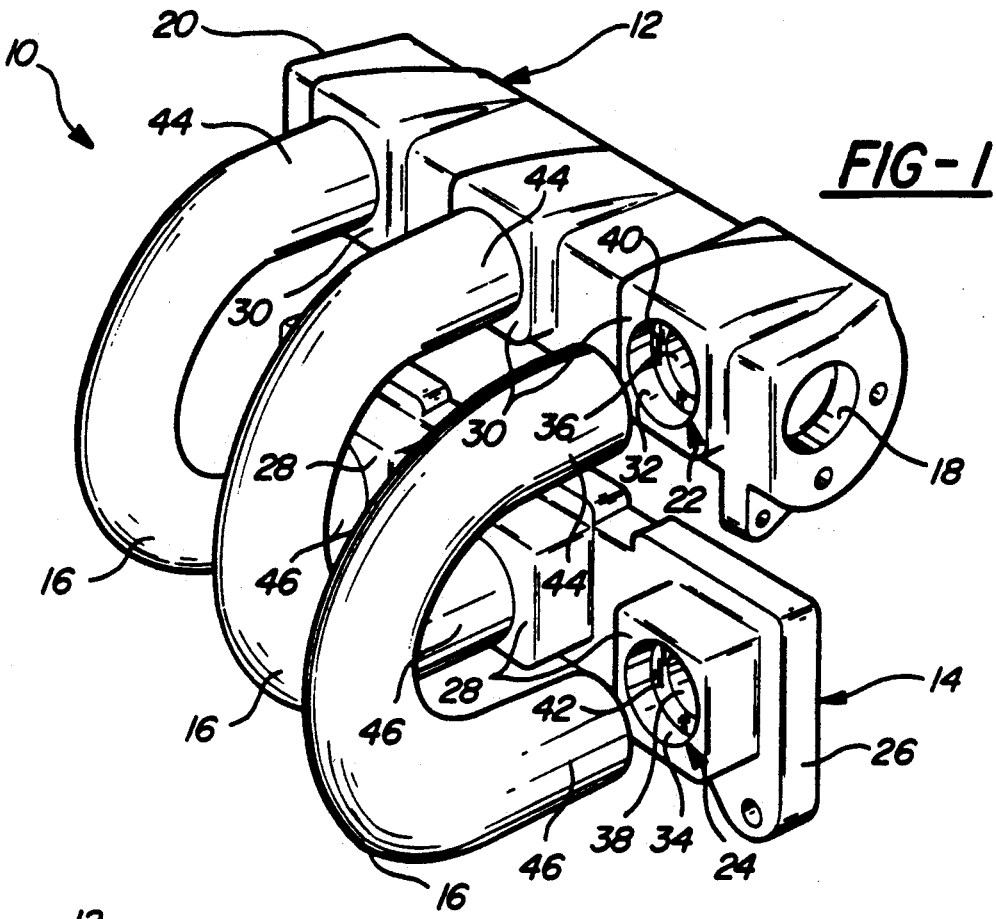
FIG. 1 is a perspective view of an intake manifold constructed in accordance with the present invention.

Referring to FIG. 1, a tubular intake manifold constructed in accordance with the present invention is generally shown at 10. The manifold 10 comprises a plenum 12, a flange 14 and a plurality of extruded aluminum U-shaped tubes 16 interconnecting the plenum 12 with the flange 14.

The plenum 12 is a cast aluminum hollowed tubular chamber having an open end 18 and opposite closed end 20. A plurality of outlet holes or openings 22 are formed in the peripheral wall of the plenum 12 between the open 18 and closed 20 ends.

Figure 2:
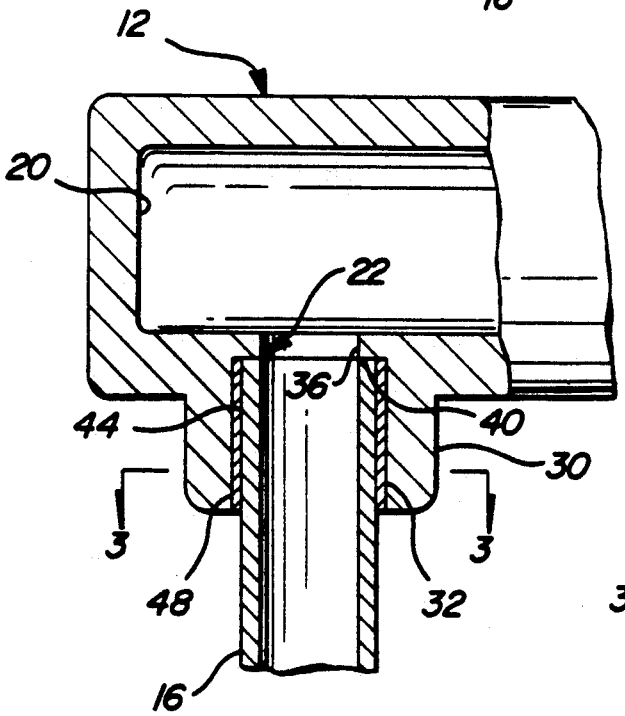
FIG. 2 is a fragmentary cross-sectional view showing the metallurgically bonded joint between the tube and plenum.
Figure 3:
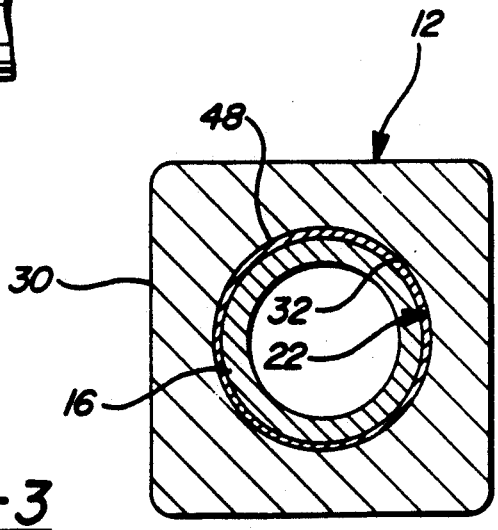
FIG. 3 is a cross-sectional view taken along lines 3—3 of FIG. 2.

The flange 14 comprises an elongated plate-like cast aluminum member having a plurality of inlet openings 24 extending therethrough and corresponding in number to the number of outlet openings 22 of the plenum 12. The flange 14 and plenum 12 further are formed with enlarged bosses 28,30. The bosses 30,28 are spaced from one another on the plenum 12 and flange 14 members for defining enlarged diameter annular wall portions 32,34 of the outlet 22 and inlet 24 holes, respectively (FIGS. 2 and 4). The enlarged diameter portions 32, 34 are dimensioned for receiving first 44 and second 46 ends of the tubes 16 with a press-fit engagement. The outside diameter of the ends 44, 46 of the tubes 16 are thus uniformally dimensioned equal to or slightly larger than the inside diameter of the enlarged portions 32, 34 of the holes 22, 24, for establishing the interference fit between the tubes 16 and the plenum 12 and flange 14 members. An overlap in size of about 5 to 10/10,000 is preferred.

The outlet 22 and inlet 24 openings may be cast into the plenum 12 and flange 14 and then the walls of the holes 22, 24 machined for developing the precise dimensional shapes of the enlarged 32, 34 and smaller 36, 38 portions of the holes 22, 24. Alternatively, the bosses 28, 30 can be cast as solid members and then entirely machined to develop the inlet and outlet openings 24, 22, respectively.

Metallurgically bonded regions 48, 50 lie between and join the ends 44, 46 of the tubing 16 to the walls of the enlarged hole portions 32, 34 of the plenum 12 and flange 14 members respectively. These metallurgically bonded regions 48, 50 comprise a low melting point coating material, such as zinc, tin or bismuth, alloyed with the aluminum tube material and further alloyed with both the aluminum plenum metal and aluminum flange metal for metallurgically bonding the ends 44, 46 of the tubing 16 to each of the plenum 12 and flange 14 members. Thus, when zinc is used as the coating material, the metallurgically bonded region or phase 48 joining the first ends 44 of the tubes 16 to the plenum 12 comprises zinc metal fused or alloyed with the aluminum tube and plenum metals, as illustrated in FIGS. 11 and 12. A similar metallurgical bond 50 is formed between the second end 46 of the tubing 16 and the flange 14, except that the metallurgically bonded region 50 comprises zinc metal alloyed with the aluminum tube and flange metals, rather than with the plenum metal (FIG. 13).

As shown in FIGS. 2-5, the entire inserted ends 44, 46 of the tubes 16 are joined to the plenum 12 and flange 14 members with the metallurgical bonds 48, 50.

A method for producing the intake manifold 10 of FIG. 1 includes first preforming each of the tubes 16 and plenum 12 and flange 14 members The plenum 12 and flange 14 members are preferably cast from aluminum or its alloys, such as 319 and 356 grades of aluminum, as well as other castable grades of aluminum. The plenum 12 is formed with the open 18 and closed 20 ends as well as the plurality of outlet holes 22 and bosses 30. The outlet holes 22 may be as-cast or subsequently machined to form the enlarged 32 and smaller 36 wall portions of the outlet holes 22. Similarly, the flange 14 is formed with the plurality of inlet holes 24 and bosses 30 and as-cast or machined to form the enlarged 34 and smaller 38 wall portions of the inlet openings 24.

The tubes 16 are extruded from aluminum and are bent into a substantially U-shaped, as shown in FIG. 1, with the outer surface of the first 44 and second 46 ends of the tubes 16 dimensioned for press-fit engagement with the enlarged annular wall portions 32, 34 of the plenum 12 and flange 14 members. In this manner, the first 44 and second 46 ends of the tubes 16 present a set of joining surfaces which are complimentary to another set of joining surfaces defined by the enlarged wall portions 32, 34 of the plenum 12 and flange 14 members.

After these members 12, 14, 16 have been formed, the joining surfaces (i.e., the ends 44, 46 of the tubing 16 and the enlarged walls 32, 34 of the outlet 22 and inlet 24 holes) are coated with a suitable low melting point molten metal coating material 52 which is compatible with the aluminum tube metal and each of the aluminum plenum and flange metals for readily alloying therewith. Thus, such low melting point coating materials as zinc, tin and bismuth are suitable material, as would be others.

The process for coating the ends 44, 46 of the tubing 16 comprises immersing the ends 44,46 of the tubes 16 into a bath of the molten coating material (e.g., zinc) while applying ultrasonic sound waves to the bath, as is depicted in FIG. 6. This process causes the molten coating material to penetrate the grain boundary structure of the tube metal, as shown in FIGS. 8 and 10, and further alloy or chemically combine with the outer surface aluminum tube metal to form alloyed phases 56 on the ends 44, 46 of the tubing 16. These alloyed phases 56 comprise the coating material 52 alloyed with the aluminum tube metal. Thus, when zinc is used as the coating material 52, the alloyed phases 56 comprise a zinc-aluminum alloy.

After the ends 44, 46 have been left in the bath of molten coating material 52 for a sufficient amount of time (a matter of mere seconds) the tubes 16 are withdrawn and the alloyed phases 56 are allowed to solidify. As the alloyed phases 56 solidify, their outer most surface oxidizes to form an oxide layer or barrier 58 on the surface of the alloyed phases 56. This oxidized layer will comprise essentially zinc oxide when zinc is used as the coating material 52.

In a similar manner, the enlarged annular wall portions 32, 34 of the plenum 12 and flange 14 members are coated with the molten coating material 52, except that the application process is different. Specifically, the molten coating material 52 is wire brushed onto the surface of the wall portions 32, 34. FIG. 7 shows the enlarged wall portion 32 of the plenum 12 being coated with the wire brush process, but it will be appreciated that this drawing is also representative of the wire brush coating process used for the holes of the flange 14.

As the molten coating material 52 is applied to the enlarged walls 32, 34 of the plenum 12 and flange 14 members, the coating material 52 is caused to penetrate the grain boundary structure of the plenum 12 and flange 14 members, as shown in FIGS. 9 and 11, respectively, and further alloy with the aluminum plenum and flange metals to form alloyed phases 60, 64 on the plenum 12 and flange 14 members similar to those on the tubing 16. Likewise, outer oxidized layers 62, 66 form on the alloyed phases 60, 64 as they solidify, and is shown also in FIGS. 9 and 11.

To promote the formation of the alloyed phases 56, 60, 64 on the tube 16 on the plenum 12 and flange 14 members, these members 12, 14, 16 may be preheated as well as their respective joining surfaces cleaned or prepared.

These alloyed phases 56, 60, 64 have characteristic solidus and liquidus transformation temperatures which identify lower temperature limits (the solidus temperatures) below which the alloyed phases 56,60,64 are completely solid and upper temperature limits (i.e., liquidus temperatures) above which the alloyed phases 56, 60, 64 are entirely in a liquid state. Between these characteristic temperatures, however, the alloyed phases 56, 60, 64 are in a partially liquid, partially solid state (i.e., a slushy state).

After the ends 44, 46 of the tubes 16 and the enlarged wall portions 32, 34 of the plenum 12 and flange 14 members have been coated and the respective alloyed phases 56, 60, 64 formed, the tubes 16, the plenum 12 and flange 14 members are heated to an elevated temperature preferably in the range between the liquidus and solidus temperatures of the alloyed phases 56, 60, 62, transforming these phases from a solid state into a slushy state. With pure zinc being used as the coating material 52, a heating range of about 800°-850° F. is acceptable, with a closer range of about 820°-830° F. being preferred.

After the members 12, 14, 16 have been heated to the proper temperature, the ends 44, 46 of the tubes 16 are forced into the associated outlet 22 and inlet 24 holes of the plenum 12 and flange 14 members with an interference fit as shown in FIGS. 12 and 13, respectfully. This interference causes the oxide layers 58 on the tube ends 44, 46 to rub or scuff against the oxide layers 62, 66 of the plenum 12 and flange 14 members as the tubes are inserted. This scuffing action disturbs or shears the oxide layers on each of the alloyed phases 56, 60, 64 and exposes fresh, unoxidized alloyed phase material This shearing action of the oxide layers 58, 62, 66 permits the underlying and mating alloyed phases 56, 60, and 56, 64 to further intermix an alloy with one another to form the metallurgically bonded regions 48, 50 between the tubing 16 and each of the plenum 12 and flange 14 members. For example, and referring to FIG. 12, the underlying alloyed phase 56 on the first end 44 of one of the tubes 16 is married with the underlying alloyed phase 60 on the enlarged wall portion 32 of one of the outlet openings 22 of the plenum 12 where they then combine to form the metallurgically bonded region 48 between the tubing 16 and plenum 12.

The slushy state of the alloyed phases 56, 60, 64 thus allows the oxide layers 58, 62, 66 to be readily sheared during joining and further allow the mating alloyed phases of the tubing 16 in each of the plenum 12 and flange 14 members to mix with one another to form the metallurgically bonded regions or phases between the ends 44, 46 of the tubing 16 and each of the plenum 12 and flange 14 members upon solidification.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method for producing a tubular intake manifold (10) for an internal combustion engine, said method comprising:

forming a metal tubular plenum member (12) having an open end (18) and an opposite closed end (20) and formed with annular wall portions its peripheral wall;

forming a complimentary flange member (14) with annular wall portions (34) defining a plurality of inlet holes (24) extending through the flange (14), With the walls (32, 34) of the outlet (22) and inlet (24) holes presenting a set of joining surfaces;

forming a plurality of metal tubes (16) having opposite ends (44,46) formed for press-fit engagement into the associated holes (22,24) of the plenum (12) and flange (14) members, with the ends (44,46) of the tubes (16) presenting a complimentary set of joining surfaces;

coating one set of the joining surfaces with a low melting point molten metal coating material (52) and allowing it to solidify;

heating the tubes (16) and plenum (12) and flange (14) members to an elevated temperature and thereafter forcing the ends (44,46) of the tubes (16) into the associated holes (22,24) of the preformed plenum (12) and flange (14) members with the joining surfaces in interference engagement with one another causing the coating material (52) to alloy with the tube metal and further with each of the plenum and flange metals and metallurgically bonding the ends (44,46) of the tubes 16 to each of the plenum (12) and flange (14) members.

2. A method as set forth in claim 1 further characterized by coating both sets of joining surfaces with the molten metal coating material (52) before joining the tubes 16 to the plenum (12) and flange (14) members.

3. A method as set forth in claim 2 further characterized by forming alloyed phases (56) on the ends (44,46) of the tubes (16) comprising the metal coating material (52) alloyed with the tube metal as a result of coating the ends (44,46) of the tube (16).

4. A method as set forth in claim 3 further characterized by forming alloyed phases (60, 64) on the annular walls (32, 34) of the plenum (12) and flange (14) members comprising the metal coating material (52) alloyed with each of the plenum and flange metals as a result of coating the annular walls (32,34) of the plenum (12) and flange (14) members, with the alloyed phases (56, 60, 64) of the tubes (16) and plenum (12) and flange (14) members having characteristic solidus and liquidus transformation temperatures.

5. A method as set forth in claim 2 further characterized by applying molten zinc to the joining surfaces as the coating material 6. A method as set forth in claim 5 further characterized by casting the plenum (12) and flange (14) members from aluminum.

7. A method as set forth in claim 6 further characterized by extruding the tubes (16) from aluminum.

8. A method as set forth in claim 7 further characterized by coating the tubes (16) by immersing the ends (44,46) of the tubes (16) into a molten bath of the zinc coating material (52) while applying ultrasonic sound waves to the bath causing the molten coating material (52) to penetrate the grain boundary structure of the tube metal and further alloy with the tube metal thereby forming alloyed regions (56) comprising the zinc coating material alloyed with the aluminum tube metal on the ends (44,46) of the tube (16).

9. A method as set forth in claim 8 further characterized by coating the annular walls (32,34) of the plenum (12) and flange (14) members by wire brushing the molten zinc coating metal onto the walls (32,34) causing the zinc to penetrate the grain boundary structure of the plenum (12) and flange (14) members and further alloying with the aluminum plenum and flange metals thereby forming alloyed phases (60,64) on the walls (32,34) comprising the zinc coating metal (52) alloyed with each of the aluminum plenum and flange metals, with the alloyed phases (56,60,64) of the tubes (16) and plenum (12) and flange (14) members having characteristic solidus and liquidus transformation temperatures.

10. A method as set forth in either of claims 4 or 9 further characterized by heating the tubes (16) and plenum (12) and flange (14) members to a temperature above the solidus temperatures of the alloyed phases (56,60,64) but below the corresponding liquidus temperatures for transforming the alloyed phases (56,60,64) to a slushy state prior to forcing the ends (44,46) of the tubes (16) into their associated holes (22,24) of the plenum (12) and flange (14) members.

11. A method as set forth in claim 10 further characterized by forming oxide layers (58,62,66) on the outer surfaces of the alloyed phases (56,60,64) as a result of the coating process.

12. A method as set forth in claim 11 further characterized by disturbing the oxide layers (58,62,66) as the ends (44,46) of the tubes (16) are forced with an interference fit into the associated holes (22,24) of the plenum (12) and flange (14) members and thereby exposing unoxidized alloyed phase material of the tubes (16) and plenum (12) and flange (14) members which then intermix forming metallurgical bonds (48,50) comprising coating material (52) alloyed with the tube metal and each of the plenum and flange metals joining the ends (44, 46) of the tubes (16) to the plenum (12) and flange (14) members.

13. A method as set forth in claim 12 further characterized heating the tubes (16) and plenum (12) and flange (14) members to a temperature of between 800°-850° F. before forcing the ends (44,46) of the tubes (16) into the associated holes (22,24) of the plenum (12) and flange (14) members.

14. A tubular intake manifold assembly (10) for use in an internal combustion engine, said assembly comprising:

a preformed preferred metal tubular plenum member (12) having an open end (18) and an opposite closed end (20) and defining a plurality of outlet holes (22) in its peripheral wall having a predetermined inner-diameter;

a preformed metal plate-like flange member (14) defining a plurality of inlet holes (24) having a predetermined inner diameter;

a plurality of preformed tubes (16) having first (44) and second (46) ends formed with an outside diameter slightly larger than the inside diameters of said outlet (22) and said inlet (24) holes, said first ends (44) of said tubes (16) received in press-fit engagement into said outlet holes (22) of said plenum and said second ends (46) of said tubes (16) being received in press-fit engagement into said inlet holes (24) of said flange (14); and characterized by metallurgical bonded regions (48, 50) formed between said ends (44, 46) of said tubes and each of said plenum (12) and flange (14) members comprising a low melting point metal material alloyed with the tube metal and each of the plenum and flange metals for metallurgically bonding said ends (44, 46) of said tubes (16) to each of the associated said plenum (12) and flange (14) members.

15. An assembly as set forth in claim 14 further characterized by the entire outer surface of the inserted ends (44, 46) of said tubes (16) being metallurgically bonded to the walls (32, 34) of the outlet (22) and inlet (24) holes 16. An assembly as set forth in claim 15 further characterized by said plenum (12), flange (14) and tubes (16) being fabricated from aluminum.

17. An assembly as set forth in claim 16 further characterized by said low melting point metal material comprising zinc.

18. A method as set forth in claim 17 further characterized by said metallurgically bonded regions (48) formed between said first end (44) of said tubes (16) and said plenum (12) comprising zinc alloyed with the aluminum tubing and plenum metals.

19. An assembly as set forth in claim 17 further characterized by said metallurgically bonded regions (50) formed between said second ends (46) of said tubes (16) and said flange (14) comprising zinc alloyed with the aluminum tubing and flange metals.

20. An assembly as set forth in claim 14 further characterized by there being 5-10/10,000 interference fit between said ends (44, 46) of said tubing (16) and said plenum (12) and said flange (14) members.

21. A method as set forth in claim 16 further characterized by said low melting point metal material comprising tin.

22. An assembly as set forth in claim 21 further characterized by said metallurgically bonded regions (48) formed between said first end (44) of said tube (16) and said plenum (12) comprising tin alloyed with the aluminum tubing and plenum metals.

23. An assembly as set forth in claim 21 further characterized by said metallurgical bonded regions (50) formed between said second ends (46) of said tubes (16) and said flange (14) comprising tin alloyed with the aluminum tubing and flange metals.

24. An intake manifold assembly for an internal combustion engine comprising;

a prefabricated cast aluminum tubular plenum member (12) having an open end (18) and an opposite closed end (20) and including a plurality of enlarged bosses (30) formed on the peripheral wall of said plenum (12) between said ends (18), (20) and defining a corresponding plurality of outlet holes (22) extending into said plenum;

a prefabricated cast aluminum plate-like flange member (14) spaced from said plenum member (12) having a plurality of enlarged bosses (28) defining a corresponding plurality of inlet holes (24) extending through said flange member (14), each of said outlet (22) and inlet (24) holes having enlarged annular wall portions (32, 34) formed with a uniform inner diameter and an adjoining smaller annular wall portion (36, 38) connected to said enlarged portions (32, 34) by shoulder, (40, 42);

a plurality of prefabricated extruded aluminum tubes (16) having first (44) and second (46) ends formed with a uniform outer diameter which is slightly larger than said inner diameters of said enlarged annular wall portions (32, 34) of said plenum (12) and said flange (14) members by about 5–10/10,000 inches, said first (44) and said second (46) ends of said tubes (16) disposed in said outlet holes (22) of said plenum (12) and said inlet holes (24) of said flange (14), respectively, with the outer surface of said first (44) and said second (46) ends being in interference engagement with said enlarged wall portions (32, 34) of said outlet (22) and said inlet (24) holes such that there is no gap between said ends (44, 46) of said tubes (16) and said plenum (12) and flange (14) members; and characterized by said outer surfaces of said tubes (16) and said enlarged wall portions (32, 34) of said outlet (22) and said inlet (24) holes defining metallurgically bonded regions (48, 50) comprising zinc metal alloyed with said aluminum tube metal and each of said aluminum plenum and flange metals for metallurgically joining the entire inserted ends (44, 46) of said tubes (16) to each of said plenum (12) and flange (14) members.

* * * * *